United States Patent [19]

Bailey et al.

[11] 4,139,486

[45] Feb. 13, 1979

[54] BUILT DETERGENT COMPOSITION

[75] Inventors: John Bailey, Crawcrook; Leslie H. Cassie; Paul R. Sherrington, both of Newcastle upon Tyne, all of England; Paul van Roo, Brussels, Belgium

[73] Assignee: The Procter & Gamble Company, Cincinnati, Ohio

[21] Appl. No.: 779,961

[22] Filed: Mar. 22, 1977

[51] Int. Cl.[2] ..... C11D 3/075; C11D 7/16

[52] U.S. Cl. ..... 252/135; 252/89 R; 252/156; 252/531

[58] Field of Search ..... 252/156, 135, 89 R, 252/531

[56] References Cited

U.S. PATENT DOCUMENTS

| | | | |
|---|---|---|---|
| 2,141,189 | 12/1938 | Lind | 252/97 |
| 2,274,584 | 2/1942 | Beller | 252/109 |
| 2,381,960 | 8/1945 | Johnson | 210/57 |
| 2,382,163 | 8/1945 | MacMahon | 252/531 |
| 2,625,514 | 1/1953 | Kirshenbauer | 252/131 |
| 2,751,357 | 6/1956 | Bowman et al. | 252/135 |
| 3,574,121 | 4/1971 | Merkenich et al. | 252/135 |
| 3,590,001 | 6/1971 | Taylor et al. | 252/135 |
| 4,007,124 | 2/1977 | Collier et al. | 252/135 |
| 4,019,999 | 4/1977 | Ohren et al. | 252/135 |

FOREIGN PATENT DOCUMENTS

| | | | |
|---|---|---|---|
| 1217469 | 5/1960 | France. | |
| 741453 | 12/1955 | United Kingdom. | |
| 804564 | 11/1958 | United Kingdom | 252/531 |

OTHER PUBLICATIONS

"The Importance of Magnesium Silicates in Fiber Protection" Seifen-Öle Fette Wachse, 11-53, by Lindner.

*Primary Examiner*—George F. Lesmes
*Assistant Examiner*—E. Rollins Buffalow

[57] ABSTRACT

Detergent compositions containing orthophosphate and pyrophosphate builders in prescribed ratios and magnesium silicate are claimed wherein the final composition has a minimum amount of free alkalinity as NaOH. The compositions demonstrate superior whiteness maintenance and lower undesirable residual deposits on fabrics washed therein. The compositions optionally contain a small amount of a water soluble magnesium salt, e.g., magnesium sulfate and may also contain phosphate more condensed than pyrophosphate.

9 Claims, No Drawings

BUILT DETERGENT COMPOSITION

BACKGROUND OF THE INVENTION

The invention relates to built detergent compositions containing ortho and pyrophosphate builders.

DESCRIPTION OF THE ART

By means of this invention, compositions can be provided which cause little or no formation of deposits upon the surfaces of the drums, and especially of the heating elements, of washing machines in which they are used repeatedly, and less deposition of insoluble inorganic matter on fabrics washed therewith in hard water than prior art compositions using similar builders.

For many years the primary detergency builder used to control water hardness in detergent products has been sodium tripolyphosphate (STPP), used at high levels, usually from about 30 to 60% of the product. Within the past few years competition from other uses of phosphate has made STPP increasingly expensive and variable in supply for detergent products; and the use of high levels of phosphates has come under scrutiny because of the suspicion that the soluble phosphates accelerate the eutrophication of natural waters such as rivers and lakes.

As more fully explained, in Belgian Pat. No. 838,553 and U.S. Pat. No. 4,019,998, ortho- and pyrophosphates can remove more hardness ions ($Ca^{++}$, $Mg^{++}$) per unit of $P_2O_5$ in their constitution than can tripolyphosphate. They do so, however, by precipitating these ions mainly as insoluble phosphates whereas sodium tripolyphosphate retains them in solution as complex ions. Unless special precautions are taken, for instance, those taught in the said patents, these precipitates cause undesirable effects upon fabrics, such as greyness or harshness of feel. Clearly, by overcoming these faults, and other faults of the compositions, a very valuable saving in usage and cost of phosphate and reduction in the amount entering natural waters could be achieved. Although, the invention described in the said patents have gone some way to overcome the objectionable deposition upon fabrics particularly, in conditions of low product concentration, wash temperature and load-to-liquor ratios, the compositions described in the said patents still cause some deposits upon the drums of washing machines and more especially upon their heating elements. The present invention improves upon these compositions especially in conditions of higher product concentration, wash temperature and load-to-liquor ratio. At the same time, deposition upon washing machine drums generally is reduced or practically eliminated and the amount of deposit upon fabrics is reduced to a level which can be accepted. This is achieved by using both ortho- and pyrophosphates together as builders, with the addition of magnesium silicate, in detergent compositions which are sufficiently alkaline, in accordance with the following definition of the composition of the present invention.

SUMMARY OF THE INVENTION

The invention provides a detergent composition comprising:

(a) from about 1% to about 70% by weight of the composition of an organic surface active agent;

(b) from about 5% to about 50% by weight of the composition of a mixture of phosphate selected from the group consisting of sodium orthophosphate, sodium pyrophosphate, potassium orthophosphate and potassium pyrophosphate wherein the weight ratio of ortho- to pyrophosphate is in the range from 9:2 to 3:7;

(c) from about 0.1% to about 10% by weight of the composition of a magnesium silicate having a ratio $SiO_2$:MgO (molar) in the range from 3.2:1 to 1:4, wherein the composition has free alkalinity of at least 2.5% NaOH by weight.

The compositions may be liquid or solid, and are preferably granular or particulate solids.

DETAILED DESCRIPTION OF THE INVENTION

The several components of the invention will now be described in detail.

Organic Surface Active Agents

Any class or organic surface active agent may be used, but it is preferred to use anionic, nonionic or zwitterionic detergents, or mixtures of any two or all of these. In solid granular compositions the content of organic surface active agent is usually in the range from 5 to 40% by weight, more preferably from 10 to 30%. In some liquid detergent compositions the content of organic surface active agent may be as high as from 30 to 70%. Many examples of suitable surface active agents are described in Belgian Pat. No. 838,553.

Preferred surface active agents and combinations of them for use in the compositions include:

Anionic detergents such as the $C_{10}$ to $C_{16}$, especially about $C_{12}$, alkyl benzene sulfonates, and $C_{10}$ to $C_{18}$ alkyl sulfates and polyethoxy alkyl sulfates, and mixtures thereof.

Nonionic detergents, especially the polyethoxy alcohols having 8 to 20 carbon atoms, and from 1 to 30 ethoxy groups, especially 4 to 10, and mixtures thereof. Valuable mixed nonionics are described in British Pat. No. 1,462,133 and British Pat. No. 1,462,134.

Particularly preferred are more or less branched (usually with 2-methyl branching) primary alkyl ethoxylates sold under the Trade Names Dobanol and Synperonic, and secondary linear alkyl ethoxylates of the Tergitol series, especially those having from about 9 – 16 carbon atoms in the alkyl groups and up to about 11, especially from about 3 to 9, ethoxy residues per molecule. Nonionics of these classes are described in Belgian Pat. No. 827,780, Belgian Pat. No. 827,781 and Belgian Pat. No. 824,848.

Zwitterionic detergents, especially the alkyl dimethyl ammonium propane sulfonates and hydroxypropane sulfonates wherein the alkyl group has 10 to 18 especially about 15 carbon atoms.

Mixtures of any of the said anionic and nonionic, and nonionic and zwitterionic detergents.

The Ortho-and Pyrophosphates Builders

The essential phosphate components are sodium or potassium ortho- and pyrophosphates. In solid compositions the sodium salts are preferred, in liquids the more soluble potassium salts may be more suitable. It is important that ortho- and pyrophosphate be present in the ratio of ortho to pyrophosphate of from 9:2 to 3:7. Preferred weight ratios of ortho- to pyrophosphate are within the ranges from 8:2 to 4:6, especially from 7:3 to 5:5. The total content of ortho- and pyrophosphate together in the compositions is preferably from 10 to 35%, more preferably from 15 to 33% by weight. If the proportion of pyrophosphate is too low, cleaning (soil removal) performance of the products begins to deteriorate.

The compositions of the invention may contain other inorganic or organic salts and compounds which have detergency building action; many such substances are known. The compositions may contain other salts or hydroxides which serve to provide necessary alkalinity as more fully described below.

Thus the use of additional condensed phosphates which are more condensed than pyrophosphates (for example sodium tripolyphosphate, or still more condensed phosphates such as glassy metaphosphates) does not normally impair the washing performance of the compositions. Their use does, of course, reduce the economy in phosphate usage achieved by the compositions, and it is preferred that the total amount of tripolyphosphate and still more condensed phosphates should not form more than 25% by weight of the total phosphates in the composition, and that any glassy metaphosphates should not form more than 4% by weight of the total compositions.

Other inorganic salts which have some detergency building effect and effect upon the alkalinity of the compositions include sodium or potassium carbonates, borates, sulfates and silicates. Yet other inorganic builders are the insoluble zeolites or aluminosilicates, which are described in Belgian Pat. No. 838,553. The latter may be present, if at all, in an amount from 1 to 40%, preferably 5 to 25%, by weight of the composition.

In solid, granular or particulate compositions it is preferred that sodium silicate be present. This may have $SiO_2$:$Na_2O$ ratio (molar) from about 1:1 to 4:1. Subject to what is explained below, the preferred ratio is from about 1.6:1 to 3.2:1, which ratios tend to give the most satisfactory spray drying behaviour and granule properties.

Examples of suitable organic detergency builders are given in Belgian Pat. No. 838,553.

The Free Alkalinity

The free alkalinity of the compositions is measured and defined by the following test. A solution of 10 g of the total composition in 990 g of water is prepared and its pH is measured, and must be above 9.5. The solution is then titrated with 0.1 N hydrochloric acid until the pH is reduced to and remains steady at 9.5. The sodium hydroxide (NaOH) equivalent to the added acid, expressed as a weight percentage of the composition, represents its free alkalinity.

The necessary free alkalinity in the compositions can be obtained by selection of the more highly alkaline of the builder or other salts, e.g. trisodium orthophosphate, sodium carbonate, sodium metasilicate, or by simply adding alkali, such as sodium or potassium hydroxide, for instance in preparing the slurry (crutcher mix) for spray drying to form granular products.

Although the invention does not in any way depend upon any theoretical explanation, some explanation of the effects of the alkalinity of compositions of the invention and of other rather similar compositions may help the reader to understand some features of the invention.

Detergent compositions built with ortho/pyrophosphate mixtures as mentioned above, tend to cause deposits upon fabrics and washing machine parts when used in hard water. These deposits are reduced when the wash is carried out in sufficiently alkaline conditions. However, strongly alkaline compositions or wash liquors are liable to be damaging to some fabrics and to be harsh to the human skin. By using magnesium silicate, according to the present invention, the degree of alkalinity at which deposition becomes slight enough to be acceptable in practice, is reduced to a level at which the compositions and the wash liquors are normally safe. However some reserve of alkalinity is necessary in the product, in particular, because most "soiling" on fabrics which are washed is acidic. Allowance for this acidity must accordingly be made, not only in formulating the compositions but also in devising realistic laboratory tests of their performance.

In the compositions of the invention, the level of free alkalinity must be at least 2.5% NaOH, as determined by the above test, and this level is adequate for washing non-acidic loads.

It is preferred that the alkalinity correspond to at least 5.5% NaOH, and especially that it should be in the range from 6% to 8%, these levels being appropriate for ordinary domestic laundry.

The Magnesium Silicate

The magnesium silicate may be preformed and added to the composition at any stage in its production. Thus it may be obtained from natural sources e.g. talc, or may be manufactured. Usually it is convenient and preferred to make it in situ during the preparation of the detergent composition, for example in preparing the crutcher mix for drying, to produce a solid composition, or in preparing a liquid composition, by reaction of a water soluble magnesium salt, such as magnesium sulfate (or Epsom salts) or magnesium chloride, with sodium silicate. The preferred molar ratio of $SiO_2$:MgO in the magnesium silicate is from 3.2:1 to 1:1.5, especially 1:1 to 1:1.5.

The amount of magnesium silicate required is quite small, as indicated above. Preferred levels are from about 1% to about 5%, especially from about 1.5% to about 3% by weight of the composition.

Now it is found that when magnesium silicate is prepared by reaction of a magnesium salt with sodium silicate, the magnesium silicate formed has the same molar ratio of silica to metal oxide as the sodium silicate. Thus if the preferred (for reasons of drying etc.) sodium silicate as described above is employed, the ratio of the magnesium silicate will be outside the most preferred range. Normally a compromise is acceptable but, by the preferred embodiment of the invention described below, any disadvantage of using magnesium silicate of other than the most preferred ratio can be overcome.

In granular or other particulate compositions it is preferred to incorporate in the composition, for example by adding to a preformed granular composition according to the invention, from about 0.5% to about 6%, more preferably from 1 to 5%, by weight of the resulting final composition, of a particulate, e.g. crystalline, water soluble magnesium salt, (calculated as anhydrous magnesium sulfate). Preferably the weight ratio of magnesium silicate to such added magnesium salt, calculated as $MgSO_4$, is from 10:1 to 1:10, especially 2:1 to 1:2. The salt can for example be magnesium chloride or magnesium sulfate (which may be in the form of their hydrates). Addition of the magnesium salt is especially desirable when the $SiO_2$:MgO ratio of the magnesium silicate is not within the preferred ranges, but their use is advantageous even when magnesium silicate with the most preferred ratio has been used. The magnesium salt should be dry mixed. Apparently it is desirable that it should not react to a considerable degree with the other components of the composition before it is dissolved in water in a wash liquor, and if necessary, the magnesium salt may be coated or otherwise protected from premature reaction with the rest of the composition. This added magnesium salt is not taken into account in the definition of the ratio of $SiO_2$:MgO in the magnesium silicate.

Composition Preparation

In preparing the compositions of the invention, the components including preformed magnesium silicate, may be mixed together in any order, and in powdery or in fluid form, e.g. in an aqueous dispersion. If the magnesium slicate is to be prepared by reaction of sodium silicate and soluble magnesium salt, some care is desirable to carry out the reaction in the absence of ions other than silicate which produce insoluble magnesium compounds. Thus for instance if the magnesium silicate is to be prepared in a typical crutcher mix or other fluid which will also contain the sodium or potassium phosphates, the sodium silicate and magnesium salt should be allowed time to react before the phosphates, or, for instance, soaps, are added. Furthermore, it is desirable to ensure that the magnesium salt and silicate are both dissolved at the time when they come into contact with one another. Thus a preferred order of mixing components of a crutcher mix for a typical detergent composition of the invention would be:

Organic detergent paste — usually containing organic surfactant, by-product, often sodium sulfate, and water.
Magnesium salt.
Sodium silicate.
Alkali e.g. sodium hydroxide, carbonate etc.
Minor components.
Sodium or potassium phosphates.

This composition may be spray dried, or dried by other means, to provide a granular composition. Usually a moisture content of about 3% to about 5% is suitable to provide nonsticky, free-flowing granules. Lower moisture contents may be employed, as disclosed in Belgian Pat. No. 838,553 as mentioned below. Higher moisture contents may sometimes be satisfactory. Epsom salts or the like may be admixed with these granules as described above.

In making the compositions it is not essential that all the phosphates should be spray dried, and some or even all of them may be dry mixed with spray dried (or otherwise dried) granules comprising other components of the composition. Thus, the compositions of the present invention may be made as described in Belgian Pat. No. 838,553, with, of course, the inclusion of magnesium silicate and sufficient alkalinity.

Subject to the requirements of the invention, such as sufficient free alkalinity, all the other normal components of detergent compositions may be present in the compositions of the invention. These include bleaching agents, such as sodium perborate or percarbonate and organic peroxy compounds and chlorine bleaches; enzymes, activators and stabilizers for bleaches or enzymes; soil suspending or soil release agents, such as sodium carboxymethyl cellulose, other cellulose derivatives, polymers and copolymers such as copolymers of methyl vinyl ether and maleic anhydride, polyacrylates etc.; suds controlling agents such as fatty acids and their soaps; tarnish inhibitors; organic solvents; hydrotropes (especially in liquid products) such as the lower alkyl benzene sulfonates; colouring matters and perfumes.

The invention is illustrated by the following Examples. All percentages are by weight.

EXAMPLE 1

The following compositions according to the invention were prepared.

| Composition | A | B | C | D | E |
|---|---|---|---|---|---|
| Crutched Components | | | | | |
| Sodium linear dodecyl benzene sulfonate | 8.0 | 8.0 | 8.0 | 8.0 | 8.0 |
| Magnesium sulfate | — | — | — | 1.5* | 1.5* |
| Magnesium silicate (Ratio $Sio_2$:MgO) | 3.0 (3.2) | 3.0 (3.2) | 3.0 (3.2) | — | — |
| Sodium silicate (Ratio $Sio_2$:$Na_2O$) | 10.0 (3.2) | 10.0 (3.2) | 10.0 (3.2) | 10.0 (2.0) | 10.0 (2.0) |
| Sodium sulfate | 18.0 | 17.0 | 16.0 | 20.9 | 20.9 |
| Sodium hydroxyide | 2.0 | 2.0 | 2.0 | 0.6 | 0.6 |
| Tallow $E_{11}$ | 1.7 | 1.7 | 1.7 | 1.7 | 1.7 |
| Fatty acid ($C_{18-20}$) | 3.5 | 3.5 | 3.5 | 3.5 | 3.5 |
| Minor components | 1.3 | 1.3 | 1.3 | 1.3 | 1.3 |
| Moisture | 4.0 | 4.0 | 4.0 | 4.0 | 4.0 |
| Sodium orthophosphate | 8.0 | 8.0 | 8.0 | 10.5 | 8.0 |
| Sodium pyrophosphate | 8.0 | 8.0 | 8.0 | 5.5 | 8.0 |
| Spray dried granules | 67.5 | 66.5 | 65.5 | 67.5 | 67.5 |
| Perfume, enzyme etc. | 0.5 | 0.5 | 0.5 | 0.5 | 0.5 |
| Magnesium sulfate | — | 1.0 | 2.0 | — | — |
| Sodium perborate | 32.0 | 32.0 | 32.0 | 32.0 | 32.0 |
| Total Product | 100.0 | 100.0 | 100.0 | 100.0 | 100.0 |
| Free alkalinity (% NaOH) | 6.0 | 6.0 | 6.0 | 5.3 | 5.3 |

*Converted to magnesium silicate by reaction with the sodium silicate.

These compositions give cleaning and stain removal equivalent to that of a fully tripolyphosphate built composition. They caused less deposition on fabrics and on washing machine parts than corresponding compositions with magnesium silicate omitted.

Similar performance is obtained if the 8% sodium dodecyl benzene is replaced by 12% of a 60:40 mixture of dodecylbenzene sulfonate and Tallowylalkyl sulfate, with a corresponding reduction in the content of sodium sulfate.

What we claim is:

1. A detergent composition consisting essentially of:
(a) from about 1% to about 70% by weight of the composition of an organic surface active agent selected from the group consisting of anionic detergent and nonionic detergent and mixtures thereof;
(b) from about 5% to about 50% by weight of the composition of a mixture of phosphates selected from the group consisting of sodium orthophosphate, sodium pyrophosphate, potassium orthophosphate and potassium pyrophosphate wherein the weight ratio of ortho- to pyrophosphate is in the range from 9:2 to 3:7; and
(c) from about 0.1% to about 10% by weight of the composition of a magnesium silicate having a ratio $SiO_2$:MgO (molar) in the range from 3.2:1 to 1:4, wherein the composition has free alkalinity of from 6% to 8% NaOH by weight.

2. A composition according to claim 1 wherein said organic surface active agent is from about 10% to about 30% by weight of the composition and wherein said phosphate mixture is from about 15% to about 33% by weight of the composition.

3. A composition according to claim 2 wherein said ratio of ortho to pyrophosphate is in the range 7:3 to 1:1.

4. A composition according to claim 3 wherein said magnesium silicate has a ratio of $SiO_2$:MgO (molar) in the range from 3.2:1 to 1:1.5.

5. A composition according to claim 4 wherein said magnesium silicate is from about 1% to about 5% by weight of the composition.

6. A composition according to claim 5 wherein said magnesium silicate has a ratio $SiO_2$:MgO (molar) in the range from 1:1 to 1:1.5 and wherein said magnesium silicate is from about 1.5% to about 3% by weight of the composition.

7. A composition according to claim 5 which also contains from about 0.5% to about 6% by weight of the composition of a particulate water soluble magnesium salt (calculated as anhydrous magnesium sulfate) wherein the weight ratio of said magnesium silicate to said particulate water soluble magnesium salt (calculated as anhydrous magnesium sulfate) is from 10:1 to 1:10.

8. A composition according to claim 7 wherein said particulate water soluble magnesium salt is from about 1% to about 5% (calculated as anhydrous magnesium sulfate) and wherein said weight ratio of said magnesium silicate to said particulate water soluble magnesium salt (calculated as anhydrous magnesium sulfate) is from 2:1 to 1:2.

9. A composition according to claim 8 which also contains a condensed phosphate more condensed than pyrophosphate so that said condensed phosphate does not form more than 25% by weight of the total amount of phosphates in the composition and so that the amount of any glassy phosphates therein is not more than 4% by weight of the total composition.

* * * * *